United States Patent [19]

Spaulding

[11] 4,154,028

[45] May 15, 1979

[54] COMBINATION FASCIA AND ROOF HEADER FOR AWNING STRUCTURES

[76] Inventor: Joseph C. Spaulding, 800 W. 13th St., Sanford, Fla. 32771

[21] Appl. No.: 869,180

[22] Filed: Jan. 13, 1978

[51] Int. Cl.[2] ..... E04D 1/36

[52] U.S. Cl. ..... 52/60; 52/74; 52/97

[58] Field of Search ..... 52/58, 60, 94, 96, 74, 52/75, 78, 97

[56] References Cited

U.S. PATENT DOCUMENTS

| | | | |
|---|---|---|---|
| 2,848,765 | 8/1968 | Showalter | 52/74 |
| 3,932,968 | 1/1976 | Heirich | 52/74 |
| 3,979,860 | 9/1976 | Roth et al. | 52/60 X |

FOREIGN PATENT DOCUMENTS

| | | | |
|---|---|---|---|
| 1609913 | 4/1970 | Fed. Rep. of Germany | 52/60 |

*Primary Examiner*—Price C. Faw, Jr.
*Assistant Examiner*—Carl D. Friedman
*Attorney, Agent, or Firm*—Duckworth, Hobby, Allen & Pettis

[57] ABSTRACT

Apparatus for mounting awning panels adjacent the roof fascia, having an overlapping roof drip edge includes a header having a first plate adapted to be mounted flush with the fascia and having a flange extending underneath the drip edge. The header is provided with a channel along the upper edge thereof, with a flap having a flange along an edge thereof, the flange of the flap engaging the header in the channel. The other edge of the flap is fastened to the field of the awning panel, and a strip of sealing material is disposed along the interface between the flap and the channel.

9 Claims, 2 Drawing Figures

COMBINATION FASCIA AND ROOF HEADER FOR AWNING STRUCTURES

BACKGROUND OF THE INVENTION

1. Field of the Invention

The present invention relates to awning and roof structures useful over windows, doors, or to create shade adjacent an existing building, and in particular relates to apparatus useful in mounting such structures to the roof fascia of an existing building in a water-tight manner.

2. Description of the Prior Art

There is a class of commercially available awning structures which are designed to be mounted adjacent an existing building to provide a means for creating shade adjacent the existing building in a water-tight manner. Typically, these awning structures are fabricated from extruded aluminum, fiberglass or similar lightweight material.

An example of a prior art system for mounting commercially available awning structures to the side of an existing building is disclosed in U.S. Pat. No. 2,755,522 to Tate, which teaches a longitudinal channel joined to the side of the building, and with the mounting structure for the awning including a plate which extends into the channel. In U.S. Pat. No. 2,746,537, Joslyn likewise discloses a channel arrangement for an awning structure, as does Herrich in U.S. Pat. No. 3,932,968.

Other prior art awning structures of interest are disclosed in U.S. Pat. No. 2,629,903 to Bird, et al., and U.S. Pat. No. 3,092,171 to Deddo.

In the mounting of such awning structures to existing buildings, it is frequently desirable to affix one end of the awning structure to the fascia panel of the roof. It is customarily a building code requirement that roofs employ a flashing about the roof edge, which is commonly referred to as a drip edge. Prior art patents disclosing such roof structures include the following: No. 3,381,425 to Gobel; No. 3,432,976 to Berg; No. 3,093,931 to Waring; No. 3,098,322 to Greene; No. 3,404,495 to Simpson; No. 873,407 to Beil; No. 1,090,985 to Hopkins; No. 2,585,324 to Hutchisson; No. 3,024,573 to McKinley and 3,344,562 to Miles, et al.

Awning structures of the type described above have proven generally unsatisfactory for mounting against roof fascia panels, because of the proximity of the roof drip edge; that is, when the awning structure is mounted in abutment against the fascia panel, the moisture dripping from the edge of the roof frequently finds its way between the awning structure and the adjacent building, resulting in unsatisfactory moisture in the area to be protected by the awning structure.

The second problem associated with the channel-type arrangements described in the prior art references referred to above, is that such channel arrangements generally require that the member mating in the channel be installed from the end of the structure, and moved into proper position by sliding the mounting structure along the channel. However, frequently the awning structure to be installed is mounted in an area where such end-on joinder to the channel is prohibited.

SUMMARY OF THE INVENTION

The present invention contemplates apparatus for mounting awning panels adjacent a roof fascia having an overlapping roof drip edge, and comprises a header having a first plate adapted to be mounted along the fascia and having a flange adapted to extend under the drip edge. A channel is provided along the upper edge of the header, with a flap having a flange along one edge thereof, the flange of the flap engaging the header along the channel. Means are provided for passing an edge of the flap opposite the one edge to an awning panel. In use, the flap may be installed in the channel by fitting the flange thereof in the channel and thereafter rotating the flap downward against the awning panel. In accordance with the present invention, the channel includes a peripheral lip spaced from an upper hook, the hook and lip being dimensioned as such that the flap, in the form of a flat plate, having peripheral flanges on the opposing edges, may be inserted face-on into the channel, and locked therein by downward rotation of the flap.

DETAILED DESCRIPTION

Figure 1:
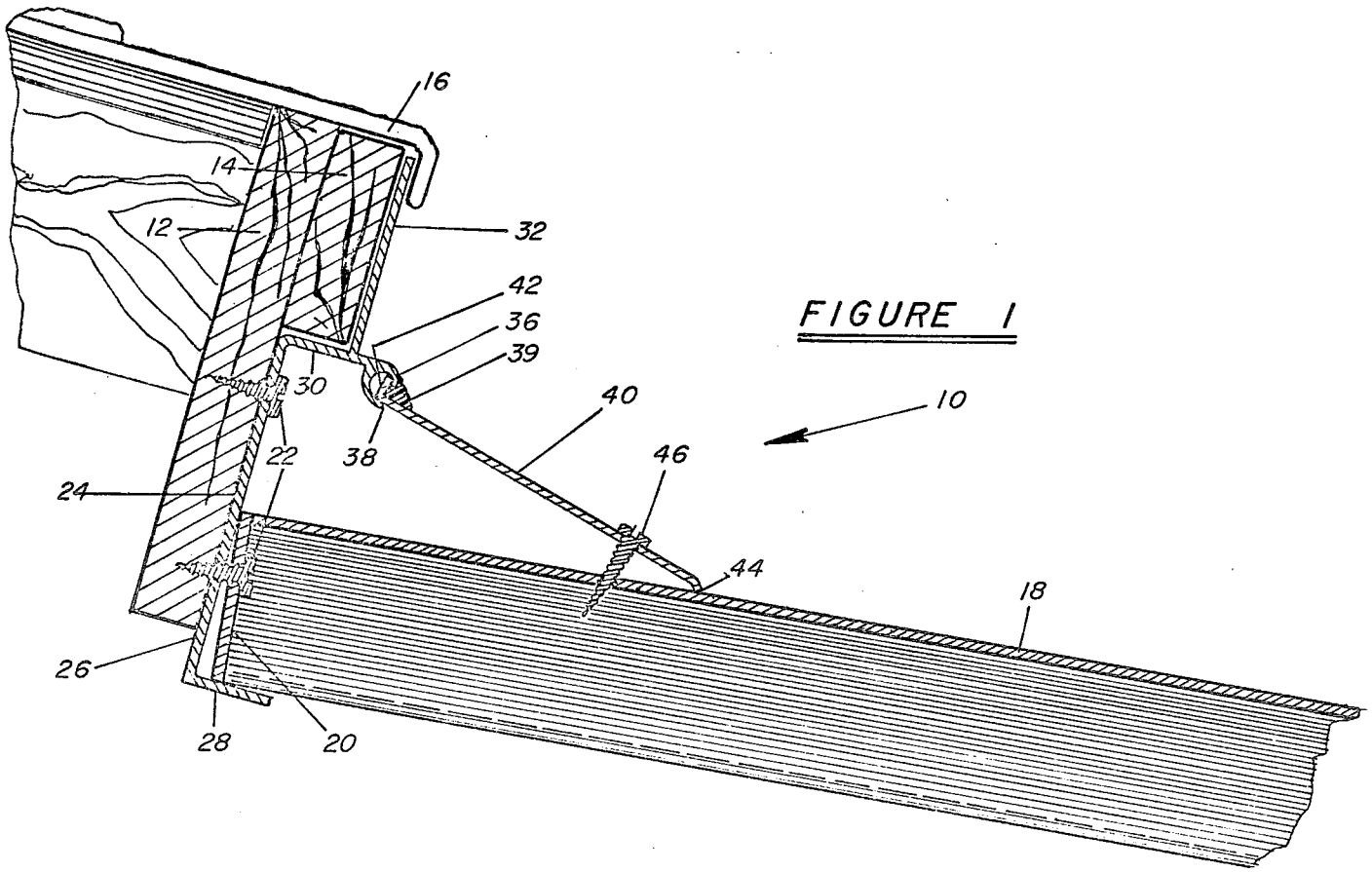

The apparatus in accordance with the present invention will now be described with reference to FIG. 1.

The structure, which is referred to generally by the reference numeral 10, is shown in association with a roof fascia panel 12 having a wooden border strip 14 along the upper edge thereof. A rain drip edge 16 overlaps the fascia panel 12 in the edge molding 14, with a small space between the drip edge 16 and the edge 14.

The apparatus 10 is utilized in conjunction with awning panels 18, similar to the awning panels 34, 42 of U.S. Pat. No. 2,755,522 to Tate, and the panels 10, 11 of the Bird, et al. U.S. Pat. No. 2,629,903, both the Bird and Tate patents being described in greater detail above. In the particular embodiment of FIG. 1, the awning panel 18 is relatively thick with respect to a thin awning panel 19 of the type shown in FIG. 2 and which will be described in greater detail below with reference thereto.

The awning panel 18 includes a butt plate 20 on one edge thereof, the plate 20 being fastened against a wall header, referred to generally as 24, and thence against the fascia panel 12 by plural fasteners, such as screws 22.

The header 24 includes a vertical plate 26 and a horizontal plate 28 extending from the bottom thereof. The header 24 further includes a second horizontal plate 30 along the upper edge thereof and a flange 32 extending from the upper plate 30 and between the roof edge 14 and the rain drip edge 16. This flange 32 forms a moisture barrier for rain falling over the rain drip edge 16. The structure 10 further includes a channel 34 extending along the peripheral edge of the upper plate 30, the channel 34 defined by a hook 36 at the peripheral edge thereof and a lip 38 extending in a curve underneath the hook, the hook and lip being spaced apart a distance sufficient to allow a flap 40 to be installed underneath the hook from the front of the channel 34.

The flap 40 is formed of a flat plate having end flanges 42, 44 at the peripheral edges thereof, the flanges 42, 44 extending in opposite directions with respect to each other. Preferably, one of the flanges 42 is substantially longer than the other flange 44. As shown in FIG. 1, the end flange 42 extends underneath the hook 36 with the flap 40 carried by the peripheral edge of the lip 38. The opposing flange 44 is in abutment with the awning panel 18, the flap being fastened to the awning panel 18 via a screw 46, or similar fastener. As likewise shown in FIG. 1, the bottom of the awning panel 18 is carried by the lower horizontal plate 28.

A good moisture seal between the ambient and the area underneath the awning panel 18 may be insured by the use of a sealing strip 39 at the interface between the hook 36 and the flap 40.

In use, the structure 10 may be installed against a fascia 12 in a simple manner, with the flange 22 extending underneath the rain drip edge 16. An important aspect of the present invention is the ability to insert the flap 40 within the channel 34 without sliding the flap along the channel from the end thereof. Rather, the flap 40 may be installed by hooking the flange 42 underneath the hook 36, and thereafter rotating the flap 40 downward until such time as the opposing flange 44 comes to rest against the awning panel 18. This feature of the present invention is better understood with reference to FIG. 2, which shows a modified form of the structure described above with reference to FIG. 1.

Figure 2:
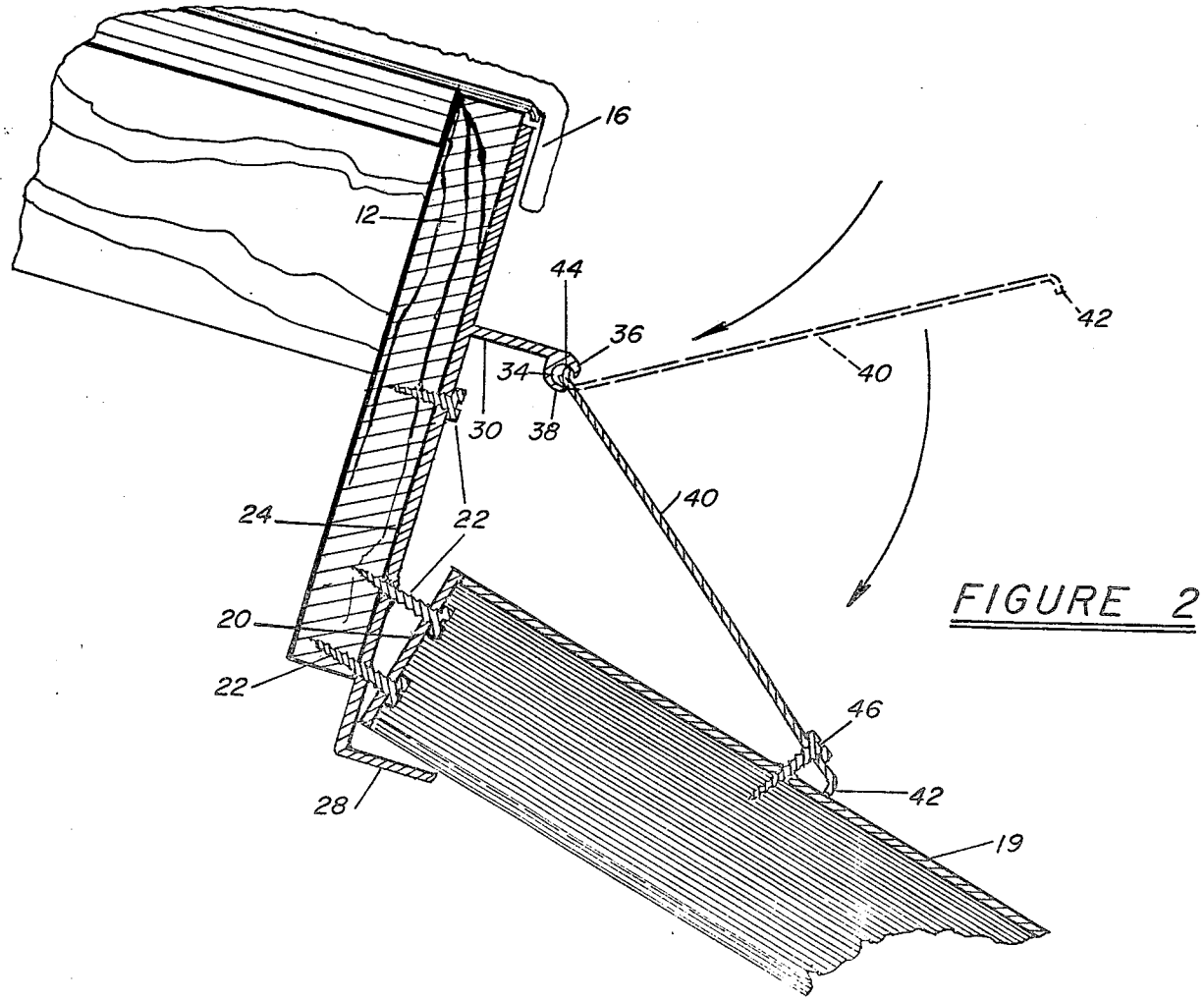

Noting FIG. 2, the wall header 24 includes plates 26, 28 and 30, channel 34 defined by lip 38 and hook 36 in a manner identical to that described above with reference to FIG. 1. The modified apparatus of FIG. 2, referred to generally as 11, includes a flange 33 which is adapted to be inserted underneath a rain drip edge, but is specifically designed for those types of fascia panels in which the rain drip edge is substantially flush with the fascia panel. That is, the modified structure 11 of FIG. 2 is designed for utilization for those roofs that omit the top edge strip 14 shown and described above with reference to FIG. 1.

The modified structure shown in FIG. 11 further includes an awning panel 19 similar to, but substantially thinner than the awning panel 18 of FIG. 1. Because a thinner awning panel is utilized in the modified structure 11 of FIG. 2, the flap 40 may be reversed such that the shorter end flange 44 is inserted within the channel 34 and underneath the hook 36. As shown by dotted lines in FIG. 2, the flap 40 is installed from the front of the channel 34 by hooking the flange 44 underneath the hook 36, thereafter rotating the flap 40 downward until such time as the opposing end flange 42 comes in contact with the thin awning panel 19. The flap 40 may then be fastened against the thin awning panel 19 via a screw 46.

It will be understood and appreciated by those skilled in the art that various modificatons may be made to the structures shown in FIGS. 1 and 2 above without departing from the spirit and scope of the present invention.

I claim:

1. In combination:

a header mounted against a fascia of a roof having a roof drip edge along the periphery thereof, said header including a flange extending underneath said drip edge;

at least one awning panel fastened to said header;

a flap having a first flange along one edge engaging said header and bearing against said awning panel at a second flange along another edge thereof;

means for fastening said another flap edge to said panel; means for defining a moisture barrier at said one edge of said flap; and wherein one of said first and second flanges is longer than the other, both said flanges extending away from said flap and in opposing direction, whereby said flap may be reversed to engage either flange with said header.

2. The combination recited in claim 1 wherein said header comprises a U-shaped member defined by two side plates and another plate therebetween, said another plate mounted against said fascia.

3. The combination recited in claim 1 wherein said header further includes a channel along said one edge, with one of said flanges engaging said header in said channel.

4. The combination recited in claim 3 wherein said channel is defined by an extrusion forming a groove and having an overhanging hook extending into said groove, said extrusion further including a lip spaced outwardly from said groove with respect to said hook.

5. In combination:

a header mounted against a substantially vertical surface, said header including a channel along a peripheral edge thereof;

at least one awning panel fastened to said header;

a flap engaging said header in said channel, said channel including means for permitting a first flange along an edge of said flap to be installed within said channel from the front thereof;

means for fastening another edge of said flap to said panels;

a second flange extending from said another edge of said flap; and wherein one of said first and second flanges is longer than the other, both said flanges extending away from said flap and in opposing directions, whereby said flap be reversed to engage either flange in said channel.

6. Apparatus for mounting awning panels adjacent a roof fascia having an overlapping roof drip edge, comprising:

a header having a first plate adapted to be mounted along said fascia and having a flange adapted to extend under said drip edge;

a channel along the upper edge of said header;

a flap having a first flange along one edge therof and a second flange along an opposing edge, said first flange of said flap engaging said header along said channel;

means for fastening said opposing edge of said flap opposite said one edge to an awning panel;

means for fastening one of each said awning panels against said head; and wherein one of said first and second flanges is longer than the other, both said flanges extending away from said flap and in opposing directions whereby said flap may be reversed to engage either flange in said channel.

7. The apparatus recited in claim 6 wherein said header includes a second plate extending away from said first plate, said channel extending along the periphery of said second plate.

8. The apparatus recited in claim 7 wherein said flange extends away from said second plate.

9. The apparatus recited in claim 7 wherein said header includes a third plate extending away from said first plate, and spaced from said second plate, said third plate supporting said awning panel.

* * * * *